United States Patent [19]

Hills

[11] 4,170,086

[45] Oct. 9, 1979

[54] STUFFED TOY ANIMAL

[76] Inventor: Isaac Hills, 18 Talley Rd., Roslyn, N.Y. 11576

[21] Appl. No.: 890,641

[22] Filed: Mar. 20, 1978

[51] Int. Cl.[2] ..... A63H 03/02

[52] U.S. Cl. ..... 46/158; 46/151

[58] Field of Search ..... 46/158, 156, 151, 162; 428/310, 160, 90

[56] References Cited

U.S. PATENT DOCUMENTS

| | | | |
|---|---|---|---|
| 875,954 | 1/1908 | Rouech | 46/158 |
| 1,513,231 | 10/1924 | English | 426/112 |
| 1,552,348 | 9/1925 | Rosenthal | 46/158 X |
| 1,595,203 | 8/1926 | Leathers | 46/156 |
| 2,819,753 | 1/1958 | Nogue | 46/156 X |
| 2,957,793 | 10/1960 | Dickey | 428/160 |
| 3,354,578 | 11/1967 | Ryan | 46/158 |
| 3,390,482 | 7/1968 | Holtvoigt | 46/158 |
| 3,400,196 | 9/1968 | Le Roy | 428/310 X |
| 3,600,261 | 8/1971 | Kerres | 428/90 |
| 3,611,757 | 10/1971 | Hills | 68/5 B |
| 3,635,786 | 1/1972 | Hughes | 428/90 |
| 3,789,547 | 2/1974 | Chemarin | 46/158 |
| 3,831,313 | 8/1974 | Cichy | 46/158 X |
| 3,955,309 | 5/1976 | Noble | 46/151 |

FOREIGN PATENT DOCUMENTS

| | | | |
|---|---|---|---|
| 1351246 | 12/1963 | France | 46/158 |

*Primary Examiner*—John F. Pitrelli

*Attorney, Agent, or Firm*—Kirschstein, Kirschstein, Ottinger & Cobrin

[57] ABSTRACT

A stuffed toy animal, having smooth, rounded, humanoid features, and comprised of an outer covering and stuffing material. The toy animal is produced by forming an outer covering having the shape of the stuffed toy animal. The outer covering is comprised of a fabric backed pile fiber material and a laminated fabric. The laminated fabric includes first and third layers comprised of a limp, knitted fabric and a second layer situated therebetween, comprised of a porous, flexible and resilient material having a modulus of elasticity sufficient to stiffen the first and third layers and impart a planar memory to the laminated fabric so that it lays substantially flat and immobilized without curling, the outer surface of the laminated fabric having an even consistency essentially free from bumps, nodes, and/or wrinkles.

15 Claims, 7 Drawing Figures

STUFFED TOY ANIMAL

BACKGROUND OF THE INVENTION

1. Field of the Invention

This invention relates to a stuffed toy animal and method of its manufacture.

2. Description of the Prior Art

Fabric backed pile fiber materials such as rayon or acrylics are commonly employed as the outer covering in the many articles. The plush pile fiber presents a fur-like appearance which is most desirable in stuffed children's toys. For example, the fur-like appearance of a stuffed toy animal simulates the feel and resiliency of an actual living animal, making the toy more familiar to the child. Thus, the simulation of playing with a living and familiar character rather than with an inanimate and abstract object is attained to a certain extent, and greater enjoyment is provided to the child. Other materials that have been used for the outer covering of the stuffed toy animal include cloth, such as cotton, wood, rayon, polyester or the like, and thin plastic films such as polyvinyl chloride, polyethylene, polypropylene, or the like.

In any case, the outer cover or skin of the stuffed toy animal is usually dyed or otherwise covered or provided with suitable appurtenances, such as a tail, to simulate the appearance of the real animal. The head of the stuffed toy animal will usually be provided with simulated fur or hair, as well as appurtenants resembling eyes, nose, mouth and ears, so as to complete the simulation of the real animal. Such toy animals are produced at low cost and typically are stuffed with foamed rubber, plastic, cotton, excelsior, sawdust, urethane, polystyrene or combinations thereof, which initially provide consistency and resilience for the stuffed toy animal.

However, after the stuffed toy animal is used by the child in his or her play for any substantial period of time, the stuffing becomes bunched and forms lumps in various parts of the figure which distorts its shape and presents a bumpy appearance. Furthermore, the remaining parts of the stuffed toy animal have empty spaces therein which cause the outer covering to wrinkle and become displaced with respect to the stuffing. Consequently, after any substantial period of use, the usual stuffed toy animal presents only a very distorted simulation of the imitated figure.

In prior art methods of manufacture, after the outer covering was die-cut into pieces, it was difficult to dye or print upon the pieces since the pieces tended to move, curl, wrinkle, or otherwise did not lay flat. Consequently, printing, marking or dyeing was accomplished prior to die-cutting the material for the outer covering into pieces. This in turn, made it difficult to align patterns such a tiger or zebra stripe along the seams of the adjacent pieces sewed together to form the outer covering without excessive waste of time or of the (striped) patterned fabric material employed. Moreover, it was difficult to use anything other than smooth stuffing to achieve a smooth surface on the outer covering of the stuffed toy animal.

SUMMARY OF THE INVENTION

1. Purposes of the Invention

Accordingly, one or more of the following objects will be achieved by the practice of the invention. It is an object of this invention to provide a stuffed toy animal having rounded and well-defined humanoid features.

An object of this invention is to provide a three-dimensional cartoon caricature of an animal in the form of a stuffed toy animal having a fur-like appearance over most of its body and a humanoid, flesh-like appearance over its ears, face, stomach, hands and/or feet.

It is also an object of this invention to provide a stuffed toy animal adapted to maintain its shape over a long period of time.

A further object of this invention is to provide a stuffed toy animal which has a life-like feel, texture and appearance.

Another object of this invention is to provide a laminated fabric comprised of at least two layers of a limp, knitted fabric separated by a layer of a porous stiffening material as part of the outer covering of the stuffed animal.

Still another object is to provide a stuffed toy animal having an outer covering comprised of a patchquilt of at least one piece of a fabric backed pile fiber material joined together with at least one piece of a laminated fabric which fabric, when stuffed, provides a smooth, wrinkle-free and crease-resistant outer surface capable of being stretched into all directions.

An object of this invention is to provide a stuffed toy animal with an outer covering which includes: (1) a patch affixed to at least one terminal member of a limb, the patch provided with a plurality of closely spaced fiber monofilamentary loops in the form of a pile, the patch and laminated fabric capable, via their respective hooks and loops, of releasably engaging the terminal member to the laminated fabric.

Another object is to provide an improved method of manufacture for a stuffed toy animal.

Still another object is to provide a method of manufacturing a stuffed toy animal employing laminated fabric pieces capable of laying flat after being cut for receiving markings thereon, facilitating the proper alignment of marked pieces to be sewn together.

It is also an object of this invention to provide a method of manufacturing a stuffed toy animal employing laminated fabric pieces which, when sewn together to form a preselected shape retain the preselected shape in the absence of stuffing therein, thereby facilitating the stuffing of the toy animal.

Another object is to provide an improved method of manufacturing a stuffed toy animal employing laminated fabric pieces wherein the waste materials used to fabricate the outer covering of the toy animal is minimized.

Still another object of this invention is to provide a method of manufacturing and stuffing a toy animal having a smooth surface on the outer covering thereof, and employing stuffing material providing an irregular outer surface beneath the outer covering of the stuffed toy animal, the smooth surfaces being associated with the portions of the outer covering comprised of a laminated fabric capable of assimilating irregularities in the surface of the stuffing materials beneath it.

These and other objects will readily become apparent to those skilled in the art in the light of the teachings hereinafter set forth.

2. Brief Summary of the Invention

The invention accordingly, constitutes the features of construction, combination of elements, arrangements of parts, in series of steps which will be exemplified in the article of manufacture and method hereinafter described and of which the scope of application will be indicated in the intended claims.

The basic article of manufacture of the present invention may be more explicitly defined as a stuffed toy animal including a head member with a face and two ears, a body member and four limbs with terminal members, the stuffed toy animal comprising: an outer covering defining a closed receptacle having the shape of the stuffed toy animal when filled, the outer covering comprised of a patchquilt of at least one piece of a laminated fabric joined together with at least one piece of a fabric backed pile fiber material, the laminated fabric piece defining a portion of one of the members and simulating humanoid features thereon, the pile fiber material defining the balance of the outer covering and providing a fur-like appearance, the laminated fabric including first and third layers comprised of a limp, knitted fabric and a second layer situated between the first and third layers and joined thereto. The second layer is comprised of a porous, flexible and resilient material having a modulus of elasticity sufficient to stiffen the first and third limp layers and impart a planar memory to the laminated fiber so that it lays substantially flat in an uncurled and immobile state when placed upon a substrate, the outer surface topography of the laminated fabric having an even consistency, essentially free from lumps or wrinkles; stuffing material beneath the outer covering, filling the closed receptacle and in contact with the inner surface of the outer covering, the stuffing material similar in shape to the closed receptacle, the outer surface of the stuffing material pressing against the inner surface of the outer covering, giving the stuffed toy animal consistency and giving the portions of the stuffed toy animal covered by the laminated fabric a fleshy and plump appearance, the laminated fabric assimilating any irregularities in the outer surface topography of the stuffing material, so that the outer surface topography of the laminated fabric maintains its even consistency.

It has also now been found that a relatively simple and effective method is provided for manufacturing a stuffed toy animal having smooth, rounded, humanoid features and including an outer covering and stuffing material comprising the steps of: cutting a laminated fabric and a fabric backed pile fiber material, respectively, into pieces, the laminated fabric including first and third layers comprised of a limp, knitted fabric and a second layer situated therebetween, comprised of a porous, flexible and resilient material having a modulus of elasticity sufficient to stiffen the first and third layers and impart a planar memory to the laminated fabric so that it lays flat and immobilized without curling, the outer surface of the laminated fabric having an even consistency essentially free from bumps, nodes and/or wrinkles; marking some of the laminated fabric pieces; forming a shaped fabric with at least one of the marked pieces, the shaped fabric capable of retaining its shape, although unstuffed and defining a humanoid facial feature; sewing together the laminated pieces, including the shaped piece, with the pile fiber pieces to form an outer covering having the shape of a stuffed toy animal, the laminated fabric pieces and markings thereon defining the humanoid features of the stuffed toy animal; leaving a seam open for the insertion of a stuffing material; stuffing the outer covering with the stuffing material; and closing the open seam.

BRIEF DESCRIPTION OF THE DRAWINGS

For a better understanding of the present invention, reference should be had to the accompanying drawings of a preferred specific embodiment thereof, wherein like numerals of reference indicate similar parts throughout the several views and wherein.

DETAILED DESCRIPTION OF THE PREFERRED EMBODIMENT

Figure 1:
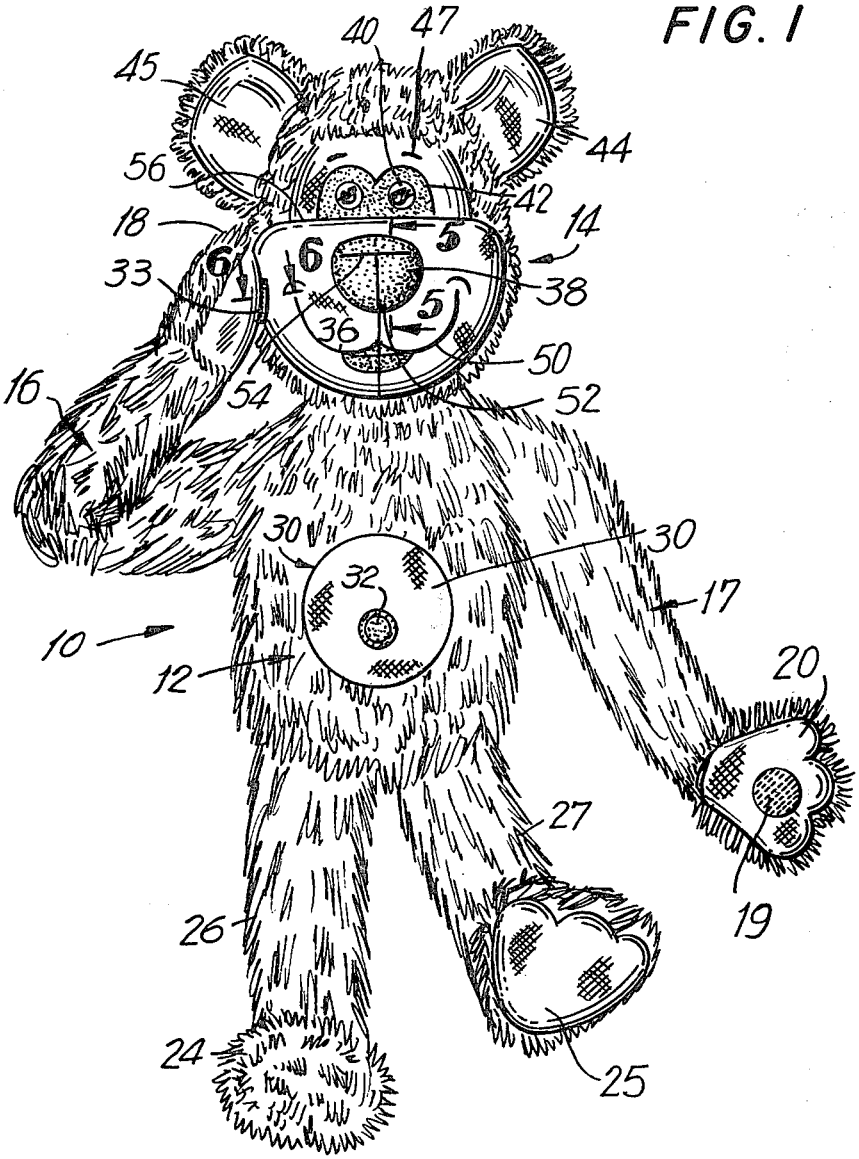
FIG. 1 is a front elevational view of a stuffed toy bear, constructed in accordance with the present invention.
Figure 2:
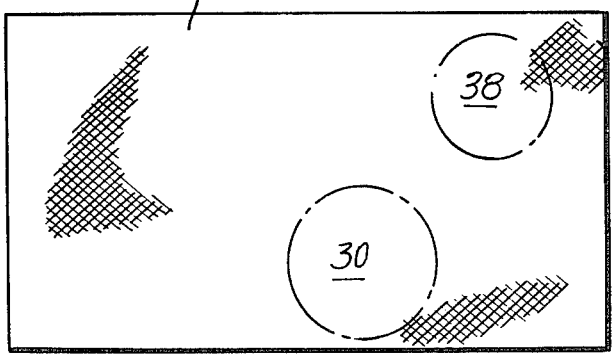
FIG. 2 is a plan view of a laminated fabric with the outline of two pieces to be cut therefrom and used in the construction of the outer covering of the stuffed toy bear shown in phantom lines.

Generally, a stuffed toy bear, in accordance with the present invention, is identified in FIG. 1 by the reference numeral 10. The stuffed toy bear 10 has a head 14 and a body 12. The limbs 16 and 17, corresponding to the toy bear's arms, have terminal members 18, corresponding to hands (paws) of the toy bear at their respective ends. The limbs 26 and 27 corresponding to the toy bear's legs, have terminal members 24, corresponding to feet (paws) of the toy bear at their respective ends. The limbs 16, 17, 26 and 27 depend from the body 12. Referring now to FIG. 1 and FIG. 2, there is shown a laminated fabric employed as part of the outer covering of the toy bear 10. For example, stomach portion 30 of the toy bear 10 is comprised of a piece of laminated fabric 55. In addition, the face of the head 14 is comprised of portions of the laminated fabric including nose portion 38. Other parts of the outer covering which are comprised of the laminated fabric includes the sole 25 of the bear's foot 24, the palms 20 of the bear's hands 18, the ears 44, 45 of the bear, and stomach portion 30. Various appurtenances such as the eyes 40, mouth line 36, nose 38 of the head 14 will preferably be of material colored differently from the basic color of the face portion of the head 14 and the body 12 as well as limbs 16, 17 26, 27, so as to provide a toy which is visually attractive and pleasing to the eye of a small child, which further adds to the pleasure of possession of the toy.

The toy bear 10 is assembled from discrete flat pieces or sections of material composed in accordance with the present invention. For example, the laminated fabric 55 shown in FIG. 2 may be cut or stamped into circular pieces 30, 38 or pieces of various other shapes, depending on the design of the toy, and the shapes may then be assembled and sewn into the outlining shape of the toy.

Figure 3:
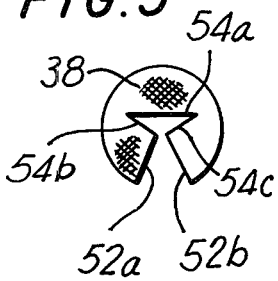
FIG. 3 is a plan view of the smaller of the two pieces cut from the laminated fabric shown in FIG. 2, which has been further cut to accommodate the nose of the stuffed toy bear.
Figure 4:
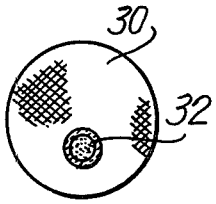
FIG. 4 is a plan view of the larger of the two pieces cut from the laminated fabric shown in FIG. 2, which piece corresponds to the stomach portion of the stuffed toy bear.

FIG. 3 shows piece 38 which has been further cut to provide a nose portion having seam edges 54A, 54B and 54C, as well as 52A and 52B, which when sewn together, define a bulbous, shaped nose portion 38 on the face of the toy bear 10. Referring to FIG. 4, stomach piece 30 is shown onto which has been imprinted belly button 32 in a different color than stomach piece 30.

Figure 5:
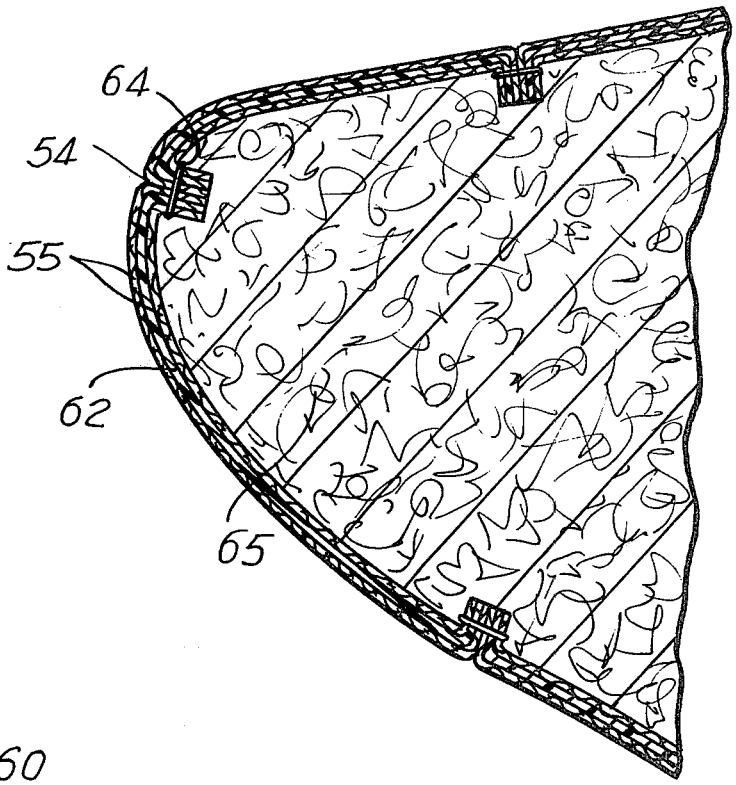
FIG. 5 is a partial sectional elevational view of the nose portion of the stuffed toy bear taken substantially along lines 5—5 of FIG. 1.
Figure 7:
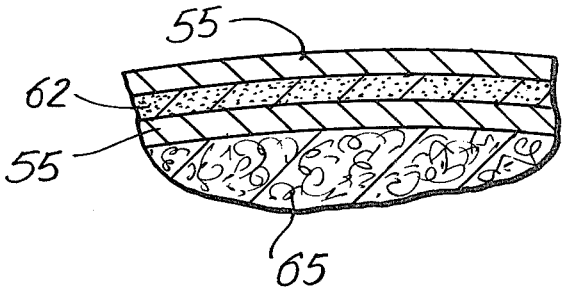
FIG. 7 is a detail showing the fabric skin of the stuffed toy bear.

During assembly of the toy bear 10, the variously shaped pieces of material are generally attached together by sewing, stitching, stapling or the like; so that seams 50, 52, 54 and 56 are visible on the face of the head 14. As can be easily visualized by reference to FIG. 5, no stuffing or stitching 64 is visable, i.e., only a joint is visible (see FIG. 1) to the eyes and the sewing or the like is on the inner surface of the outer covering of toy bear 10. FIGS. 5 and 7 further illustrate the internal stuffing material 65 of the toy bear 10. As shown in FIGS. 1, 5 and 7, the toy bear 10 comprises an outer covering or skin which is comprised of a fabric-backed pile fiber material and a laminated fabric, together with stuffing material 65 in the central body cavity of the toy bear 10 defined by its outer covering.

The first and third layers of the laminated fabric suitable for this invention comprise a limp, knitted fabric. Suitable knitted fabrics include low nap fabrics, no nap fabrics, low pile plush fabrics, and the like. Particularly preferred is tricot, a flat bed knitted fabric. The fibers of these materials may be comprised of wool, cotton, polyester, nylon, rayon, combinations thereof, and the like. In a preferred embodiment of the present invention, a low loop pile material which has been brushed sufficiently to break some but not all of the loops, is employed for the first layer. The number of unbroken loops that remain after brushing are sufficient to releasably engage a plurality of monofilamentary hooks (such as those sold under the trade name "Velcro"). The third layer need not have any nap and need not be brushed because it is concealed and such construction and treatment which preferably is employed for the first layer would represent an unnecessary expense.

The second, i.e., intermediate, layer of the laminated fabric is comprised of a semi-resilient fabric or foamed plastic. For example, the semi-resilient fabric may be comprised of a cotton, non-woven felt impregnated with a plastic. By foamed plastic is meant various types of plastics and plastic-like materials, having a resilient open or closed foam texture, such as polyurethane foam, polyvinyl chloride foam, foamed natural or synthetic rubber and the like. The polyurethane foams which are suitable are typically classed as open cell materials. This means that they are flexible foams. The starting foams desirably possess significant porosity or perviousness to air, water-vapor and liquid-water. It is preferred that substantially cured polyurethane foams be employed.

The second layer of the laminated fabric is bonded to the first and third layers by methods well known to those skilled in the art, such as by application of heat and pressure via a bonding roll. For example, a suitable adheasive such as glue or resin may be applied to the interfaces between the first, third and second layers prior to bonding, by coating the surfaces of the first and third layers, and/or the second layer prior to passage through the bonding roll. Preferably, first and third layers comprised of a tricot are flame-bonded to a polyurethane foam to form the laminated fabric. The second layer is self-foam maintaining, i.e. will resume a normal flat condition when no deforming stress is applied thereto. The second layer imposes this characteristic on the laminated fabric.

The resultant laminated fabric may be cut out or stamped into pieces of various shapes, depending upon the design of the stuffed animal, such as the stuffed toy bear 10. The shaped pieces are then assembled and sewn together in a pre-selected design along with one or more pieces of a fabric-backed, pile fiber material. An advantage of the laminated fabric of this invention is that individual pieces thereof may be marked upon easily by silk screening, painting, dyeing printing or the like. The bulk of the laminated fabric attributable to the presence of the second layer and the self-form maintaining characteristic causes the fabric to lay flat without curling attributable to the same layer, moving or wrinkling or creasing, i.e.; it remains immobile, resembling a stiff paper-like poster board, in this condition pieces of the fabric can be printed easily. However, when sewn so as to stress one or more flat pieces of said laminated fabric into a curved or shaped configuration such as that, for example, resembling a nose of an animal (see FIG. 3), the laminated fabric retains its contoured configuration without being stuffed. This allows for imprecise stuffing techniques to be employed, to easily stuff a toy animal according to this invention.

During assembly of the stuffed toy bear 10, the shaped pieces of laminated fabric and fabric-backed pile fiber material are sewn together into a patchquilt which defines the outer covering, a closed receptacle in the form of the bear 10, leaving a seam open for insertion of stuffing material 65, which may be any suitable stuffing material, such as shredded foamed plastic, e.g., shredded polyurethane or polyvinyl chloride foam or foamed rubber, cotton batting, pieces or shreds of cloth, pieces of natural or synthetic fibers, cellulose, excelsior, kapok, polystyrene or the like. A particular feature of this invention is that kinks or otherwise lumpy stuffing may be employed and yet the outer covering comprised of the laminated fabric will still retain its smooth, outward appearance and "hand", the feel of the fabric. The stuffed toy bear 10 is completed by sewing or otherwise fastening the final open seam, and attaching suitable decorative appurtenances thereto, if deemed desirable. The decorative pieces or appurtenances may alternatively be attached to individual laminated fabric pieces of toy bear 10, prior to assembly of the pieces, either by sewing, gluing or the like as previously mentioned.

A particular feature of the invention is that toy bear 10 has a wrinkle-free and crease-free appearance, increasing its attractiveness to children. Toy bear 10 has the warm feel, appearance and texture of a one-piece toy animal molded from foamed plastic; however, no costly molding equipment is required such as special molds, molds, etc. The toy bear 10 can be fabricated with inexpensive existing equipment and thus the product is highly competitive in the marketplace. It is light in weight and easily handled by a small child, yet it is resilient and life-like to the touch, and thus toy bear 10 is extremely attractive to small children. Toy bear 10 is composed of inexpensive materials and is manufactured and assembled in an inexpensive manner, yet it has the strength, firmness and resilience of a molded toy animal. Thus, the present toy bear 10 provide a substantial improvement in the art of toy manufacture, by providing a warm and cuddlesome toy for small children which has a life-like feel and resilience.

In a preferred embodiment of the present invention, fasteners such as those sold under the trademark Velcro may be advantageously employed. Such fastener patches are described in U.S. Pat. Nos. 2,717,437; 3,009,235; 3,076,244; 3,083,737; 3,147,528; 3,154,837, and 4,058,853.

Referring now to FIG. 1, there are shown flexible hook patches 19 and 33, on the palms 20 of the hands of the bear 10. These flexible hook patches are releasably engageable with the loops of the first layer of the laminated fabric on the outer covering or skin of the bear 10. Thus, the two hands may be manually juxtaposed over a portion of the laminated fabric of this invention and pressed towards the laminated fabric. When the flexible hook patch 19 or 33 engages the loops in the outer surface of the laminated fabric of this invention, it releasably adheres thereto. The hands may be released from the laminated fabric by manually pulling them away from the laminated fabric.

Figure 6:
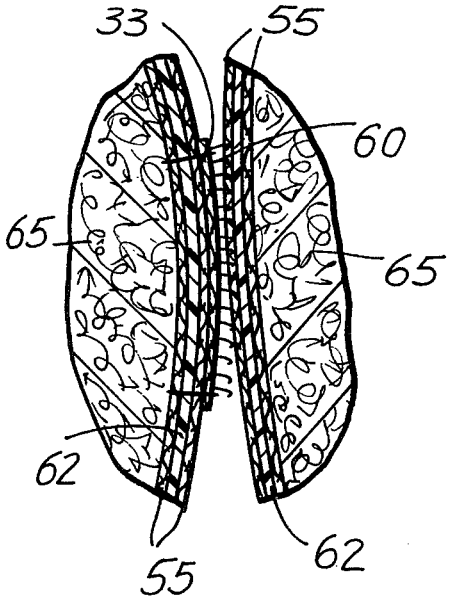
FIG. 6 is a partial sectional plan view taken substantially along the lines 6—6 of FIG. 1 and showing a terminal member of a limb attached to a face portion of the stuffed toy bear.

This embodiment of the present invention consequently, includes a flexible hook patch such as 19 or 33, which is secured via stitching (not shown) or other fastening, to the exterior surface of the palms 20 of toy bear 10. The patches 19 and 33 are characterized by the provision of a plurality of hooks 60, constituting a plurality of closely spaced monofilamentary plastic hooks in the flexible hook patches 19 and 33. As shown in FIG. 1, patch 33 is secured to palm 20 which, in turn, is releasably engaged with a portion of the face of toy bear 10. As can be seen from FIG. 6, the hooks 60 engage the first outer layer of the laminated fabric, particularly the plurality of loops in a pile at the outer surface of the first layer which releasably engage hooks 60.

The flexible resilient hooks 60 are typically composed of plastic such as nylon, polyvinyl chloride, polyvinyl acetate, polyethylene, polypropylene, etc.

Because of the nature of the hooks 60 and of the loop pile of the first layer of the laminated fabrics, the hands via the hook patches may be joined and separated thousands of times to the laminated fabric before the joint is weakened, i.e. the closure will last beyond the life of the toy bear 10 itself. Moreover, the hands can releasably be engaged with any other portions of the outer covering which are comprised of the laminated fabric such as the stomach portion, the ears, and the face portion.

Thus it will be seen that there is provided a toy bear 10 and method of manufacture thereof which achieves the various objects of the invention and which is fully adapted to meet the conditions of practical use.

As various possible embodiments may be made of the above invention and various changes might be made in the embodiment above set forth, it is to be understood that all matter herein described or shown in the accompanying drawings is to be interpreted as illustrative and not in a limiting sense. Thus, it will be understood by those skilled in the art that although a preferred embodiment has been shown and described in accordance with the patent statutes, the invention is not limited thereto or thereby.

Having thus described the invention, there is claimed as new and desired to be secured by letters patent:

1. A stuffed toy animal including a head member with a face and two ears, a body member and four limbs with terminal members, the stuffed toy animal comprising:

an outer covering defining a closed receptacle having the shape of the stuffed toy animal when filled, the outer covering comprised of a patchquilt including at least one piece of a laminated fabric joined together with at least one piece of a fabric backed pile fiber material, the laminated fabric piece defining a portion of one of the members and simulating humanoid features thereon, the pile fiber material providing a fur-like appearance, the laminated fabric including first and third layers comprised of a limp knitted fabric and a second self-form-maintaining semi-resilient layer situated between the first and third layers and joined thereto, the second layer comprised of a porous, flexible and resilient material having a modulus of elasticity sufficient to stiffen the first and third limp layers and impart a planar memory to the laminated fabric so that it lays substantially flat in an uncurled and immobile state when lying unstressed upon a flat substrate, the outer surface topography of the laminated fabric when incorporated in the animal having an even consistency essentially free from lumps or wrinkles, and stuffing material beneath the outer covering filling the closed receptacle and in contact with the inner surface of the outer covering, the stuffing material assuming the shape of the closed receptacle, the outer surface of the stuffing material pressing against the inner surface of the outer covering giving the stuffed toy animal consistency and giving the portions of the stuffed toy animal covered by the laminated fabric a fleshy and plump appearance, the laminated fabric assimilating any irregularities in the outer surface topography of the stuffing material so that the outer surface topography of the laminated fabric in the animal maintains its consistency.

2. A stuffed toy animal as defined in claim 1 wherein said one piece of said laminated fabric defines the face of said head member, and wherein said outer covering further includes a second piece of said laminated fabric defining a nose portion, of said head member, said first pieces containing one-dimensional markings thereon simulating three-dimensional, humanoid facial features, said second piece being convexly contoured to resemble a cup-shaped nose of said stuffed animal, said second piece being joined to said first piece.

3. A stuffed toy animal as defined in claim 1 wherein said outer covering further includes third and fourth pieces of said laminated fabric which are joined to the head member, contiguous with the pile fiber material and defining the ears of said stuffed toy animal, said ears being devoid of said stuffing material.

4. A stuffed toy animal as defined in claim 1 wherein said outer covering further includes fifth, sixth, seventh and eighth pieces of said laminated fabric joined to ends of the four respective limbs of said stuffed toy animal and contiguous to said pile fiber material, and defining said four terminal members, respectively of said limbs.

5. A stuffed toy animal as defined in claim 4 wherein said knitted fabric includes loops and further including a flexible hook patch comprised of a plurality of monofilamentary flexible hooks said patch joined to at least one of said fifth through eight laminated fabric pieces, said flexible hook patch being releasably engageable with said loops.

6. A stuffed toy animal as defined in claim 1 wherein said outer covering further includes a ninth piece of said laminated fabric joined to said pile fiber material and defining a stomach portion of said body member, said ninth piece containing one-dimensional markings thereon resembling three-dimensional humanoid features.

7. A stuffed toy animal as defined in claim 1 wherein said knitted fabric is selected from the group consisting of no nap fabrics, low nap fabrics and low pile plush fabrics.

8. A stuffed toy animal as defined in claim 7 wherein said knitted fabric is a low loop pile material which has been brushed to break some but not all of the loops.

9. A stuffed toy animal as defined in claim 7 wherein said knitted fabric is tricot.

10. A stuffed toy animal as defined in claim 9 wherein said foamed plastic is a polyurethane foam.

11. A stuffed toy animal as defined in claim 10 wherein said tricot layers are flame bonded to said polyurethane foam layer.

12. A stuffed toy animal as defined in claim 1 wherein said second layer is comprised of a material selected from the group consisting of a stiffened fabric and a foamed plastic.

13. A stuffed toy animal as defined in claim 12 wherein said stiffened fabric is a cotton, nonwoven felt.

14. A stuffed toy animal as defined in claim 12 wherein said foamed plastic is selected from the group consisting of polyurethane foam, polyvinyl chloride foam and foamed synthetic rubber.

15. A stuffed toy animal as defined in claim 1 wherein said stuffed material provides a kinked or lumpy outer surface topography when stuffed within said outer covering.

* * * * *